US010993532B1

(12) United States Patent
Goldstein et al.

(10) Patent No.: US 10,993,532 B1
(45) Date of Patent: May 4, 2021

(54) ART SUPPLY STORAGE RACK

(71) Applicants: Heather E. Goldstein, Raleigh, NC (US); Christopher M. Pizzichemi, New York, NY (US)

(72) Inventors: Heather E. Goldstein, Raleigh, NC (US); Christopher M. Pizzichemi, New York, NY (US)

(73) Assignee: Heather Goldstein, Raleigh, NC (US)

( * ) Notice: Subject to any disclaimer, the term of this patent is extended or adjusted under 35 U.S.C. 154(b) by 0 days.

(21) Appl. No.: 16/999,647

(22) Filed: Aug. 21, 2020

(51) Int. Cl.
*A47B 81/00* (2006.01)
*B44D 3/12* (2006.01)
*A47B 47/00* (2006.01)

(52) U.S. Cl.
CPC ..... *A47B 81/00* (2013.01); *A47B 47/0075* (2013.01); *B44D 3/125* (2013.01)

(58) Field of Classification Search
CPC . A47B 81/00; A47B 47/0066; A47B 47/0075; A47B 47/021; A47B 47/0025; A47B 47/06; A47B 47/00; A47B 47/042; A47F 7/0028; A47F 5/116; A47F 7/145; A47F 7/0035; A47F 7/0021; A47F 5/11; B44D 3/125; B44D 3/123
USPC ..... 211/128.1, 85.18, 65, 69.1, 69.2, 69.4, 211/71.01, 85.13, 60.1, 68, 62
See application file for complete search history.

(56) References Cited

U.S. PATENT DOCUMENTS 454,772 A * 6/1891 Sagar ..... A47B 73/00 211/74
540,861 A * 6/1895 Hart ..... A47G 25/12 211/62
D28,203 S * 1/1898 Shelverton ..... D18/56
731,710 A * 6/1903 Renken ..... A47B 73/00 211/74
877,145 A * 1/1908 Waddell ..... A47G 7/03 47/41.13
1,092,156 A * 4/1914 Mathis ..... A61L 2/00 206/207
1,615,323 A * 1/1927 Brown ..... A47F 3/14 108/92
1,662,077 A * 3/1928 Schwartz ..... B43M 99/00 211/69.9

(Continued)

FOREIGN PATENT DOCUMENTS

SE 200401362 * 3/2005

*Primary Examiner* — Jonathan Liu
*Assistant Examiner* — Devin K Barnett
(74) *Attorney, Agent, or Firm* — Robert G. Rosenthal

(57) ABSTRACT

An art supply storage rack stores and organizes paint tubes and paintbrushes The rack comprises a plurality of vertical supports, lower middle and upper horizontal members each have a plurality of spaced openings. A base member includes a plurality of spaced retaining slots and is positioned vertically spaced apart from and beneath the lower horizontal member. The base member and the respective lower, middle and upper horizontal members are connected to the vertical supports and define a frame. The respective horizontal members are vertically spaced and offset from each other in stepped fashion such that the openings overlie the respective retaining slots in the base member to define a paint tube holding shaft. The respective paint tube shafts are adapted to hold paint tubes. Other openings hold paintbrushes.

10 Claims, 22 Drawing Sheets

(56) References Cited

U.S. PATENT DOCUMENTS 1,777,542 A * 10/1930 Baerman ..... A47F 5/108 312/200
1,879,943 A * 9/1932 Miller ..... A47F 5/0018 211/128.1
D90,663 S * 9/1933 Kohlmetz ..... D6/674
1,955,370 A * 4/1934 Snook ..... A47F 5/0018 312/119
2,124,771 A * 7/1938 Fish ..... B43L 25/00 222/577
2,160,661 A * 5/1939 Huott ..... B43L 27/02 15/257.073
2,321,339 A * 6/1943 Wadsworth ..... A47F 7/02 206/560
2,366,676 A * 1/1945 Rosenthal ..... A47B 47/042 108/180
D157,024 S * 1/1950 Bacco et al. ..... D6/682.2
D169,077 S * 3/1953 Mains, Jr. ..... D6/682.2
2,825,101 A * 3/1958 Rubenstein ..... A47B 47/042 403/217
D185,807 S * 8/1959 Antle ..... D22/107
3,286,847 A * 11/1966 Leblanc ..... B44D 3/123 211/65
3,302,798 A * 2/1967 Le Blanc ..... B44D 3/123 211/65
3,365,761 A * 1/1968 Kalvig ..... B25H 3/04 248/113
3,379,315 A * 4/1968 Broadwin ..... B01L 9/543 211/72
3,456,806 A * 7/1969 Borston ..... A45D 6/00 211/60.1
3,465,872 A * 9/1969 Stapleton ..... B65D 51/24 206/209
3,532,222 A * 10/1970 Madden ..... B44D 3/04 211/65
4,011,954 A * 3/1977 Galli ..... A47F 5/04 211/14
D250,441 S * 12/1978 Richman ..... D28/73
4,162,581 A * 7/1979 O'Connor ..... G09B 19/00 434/259
4,196,812 A * 4/1980 McInnis ..... A47B 81/067 211/194
D283,164 S * 3/1986 Pandya ..... D19/75
5,129,528 A * 7/1992 Eidsmoe ..... B25H 3/003 211/69
D336,802 S * 6/1993 Eidsmoe ..... D19/75
5,579,702 A * 12/1996 Aho ..... A47B 87/008 108/91
5,615,782 A * 4/1997 Choe ..... A45D 1/00 211/60.1
5,617,960 A * 4/1997 Bishop ..... A47B 97/02 211/44
5,823,363 A * 10/1998 Cassel ..... A61M 5/3213 211/60.1
5,836,446 A * 11/1998 Varnom ..... B25H 3/026 206/373
6,035,857 A * 3/2000 Hartelius ..... A45D 29/20 132/73
6,126,022 A * 10/2000 Merkel ..... A47B 47/042 108/180
6,230,985 B1 * 5/2001 Wang ..... B05B 15/65 239/273
6,398,045 B1 * 6/2002 Chao ..... A47F 7/0028 211/181.1
RE38,707 E * 3/2005 Merkel ..... A47B 47/042 108/180
D512,282 S * 12/2005 Martin ..... D7/600.4
7,258,240 B2 * 8/2007 Wescott, III ..... B01L 9/06 211/74
D555,936 S * 11/2007 King ..... D6/675.3
D574,434 S * 8/2008 Siegel ..... D19/85
7,533,940 B1 * 5/2009 Zook ..... A47B 83/02 297/440.13
D669,528 S * 10/2012 Strain ..... D19/105
D673,392 S * 1/2013 Noppe ..... D6/675.3
D680,353 S * 4/2013 Hawkins ..... D6/682.4
D720,951 S * 1/2015 Hawkins ..... D6/682.2
D885,092 S * 5/2020 Greenwood ..... D6/675.3
2002/0153336 A1 * 10/2002 Wang ..... A47F 7/0028 211/60.1
2003/0116516 A1 * 6/2003 Belokin ..... A47F 7/0028 211/69.5
2003/0234230 A1 * 12/2003 Wang ..... A47F 7/0028 211/70.6
2004/0016710 A1 * 1/2004 Kjelgaard ..... B43M 99/006 211/69.5
2004/0188367 A1 * 9/2004 Pleiman ..... B25H 3/04 211/70.6
2006/0180559 A1 * 8/2006 Roberti ..... B44D 3/12 211/65
2006/0261023 A1 * 11/2006 Goth ..... A47F 11/10 211/128.1
2007/0062892 A1 * 3/2007 Donnellan ..... A47B 49/00 211/74
2008/0277296 A1 * 11/2008 LaBrasca ..... B43K 23/001 206/214
2011/0031136 A1 * 2/2011 Strain ..... B44D 3/04 206/1.7
2012/0111815 A1 * 5/2012 Berry ..... A47J 47/16 211/74
2012/0175328 A1 * 7/2012 Bosch ..... A47B 87/0223 211/85.18
2012/0285912 A1 * 11/2012 Koessl ..... A47B 47/045 211/70.6
2013/0062293 A1 * 3/2013 Beaty ..... A47B 47/042 211/59.2
2013/0062294 A1 * 3/2013 Beaty ..... A47B 47/042 211/59.2
2013/0112636 A1 * 5/2013 Williams-Shelton ..... A47F 7/00 211/85.13
2013/0206714 A1 * 8/2013 Pedersen ..... A47G 7/041 211/71.01
2013/0256253 A1 * 10/2013 Stuby ..... A47B 87/005 211/186
2015/0144578 A1 * 5/2015 Maiden ..... A47B 47/0075 211/26
2018/0112696 A1 * 4/2018 Davis ..... F16B 12/46
2019/0040890 A1 * 2/2019 Davis ..... A47B 88/941
2019/0059594 A1 * 2/2019 Davis ..... A47B 47/0066
2020/0037759 A1 * 2/2020 Ward ..... A47F 5/0062

* cited by examiner

ART SUPPLY STORAGE RACK

FIELD OF THE INVENTION

This invention relates generally to the field of storage racks and more particularly to the field of racks for the efficient storage and retrieval of artists' paints and paintbrushes.

BACKGROUND OF THE INVENTION

For centuries artists have struggled to organize their supplies including paints and paintbrushes. Organization of brushes ranges from nonexistent when brushes are merely dropped on a table top to the usual deposition bristle end up in a cup or similar container. Paint tubes are also generally strewn on a surface or piled into a box. The foregoing arrangements are suboptimal as time is wasted looking for a particular brush or paint color. Additionally, contamination between colors and mediums can ruin expensive paints.

In view of the forgoing it is an object of the art supply storage rack according to the present invention to overcome the objections and deficiencies of the prior art.

Another object of the art supply storage rack according to the present invention to enhance artist productivity.

A further object of the art supply storage rack according to the present invention to reduce paint contamination.

A still further object of the art supply storage rack according to the present invention is to store and paint tubes with enhanced visibility of labels indicating medium and color.

SUMMARY OF THE INVENTION

The benefits and advantages of the present invention are achieved in an art supply storage rack for storing and organizing paint tubes of the type having a tube body with an orifice at one end through which paint is expressed and a sealed opposite end. The rack comprises a plurality of vertical supports, a lower horizontal member has a plurality of spaced openings, a middle horizontal member has a plurality of spaced openings and an upper horizontal member has a plurality of spaced openings. A base member includes a plurality of spaced retaining slots and is positioned vertically spaced apart from and beneath the lower horizontal member. The base member and the respective lower, middle and upper horizontal members are connected to the vertical supports to define a frame. The respective horizontal members are vertically spaced and offset from each other in stepped fashion such that the openings overlie the respective retaining slots in the base member to define a paint tube holding shaft. The respective paint tube shafts are constructed and arranged to receive a paint tube with the sealed end being restingly received in the retaining slots with the orifice end protruding above the respective opening in one of the horizontal members.

In another aspect of the invention, the art supply storage rack is further adapted to hold paintbrushes of the type having an elongate handle with a proximal end with bristles and a distal end. The rack is configured such that a portion of the middle horizontal member extends beneath the upper horizontal member and the middle horizontal member and the upper horizontal member each include a plurality of paintbrush openings. The respective paintbrush openings overlie each other to define a paintbrush holding shaft that is adapted to retain a paintbrush whereby a paintbrush is maintained upright when inserted in a paintbrush holding shaft.

BRIEF DESCRIPTION OF THE DRAWINGS

Some of the features and advantages of the invention having been briefly stated, others will appear from the description which follows, when taken in connection with the accompanying drawings, in which.

DETAILED DESCRIPTION OF THE ILLUSTRATED EMBODIMENTS

While the present invention will be described more fully hereinafter with reference to the accompanying drawings, in which particular embodiments are shown, it is to be understood at the outset that persons skilled in the art may modify the invention herein described while still achieving the favorable results of this invention. Accordingly, the description which follows is to be understood as a broad teaching disclosure directed to persons of skill in the appropriate art and not as limiting upon the present invention.

Figure 1:
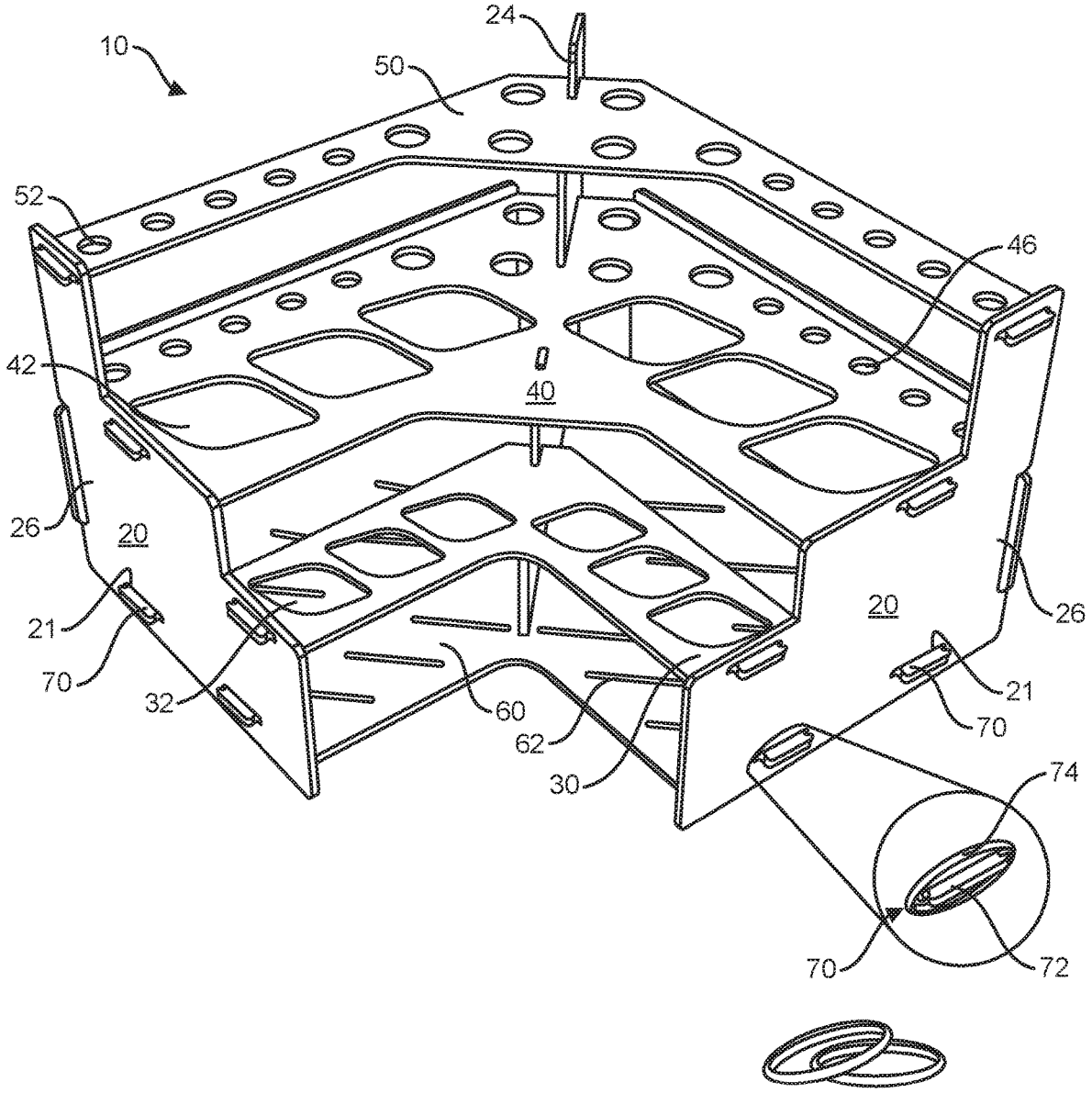
FIG. 1 is a perspective view of a first embodiment of the art supply storage rack according to the present invention.
Figure 2:
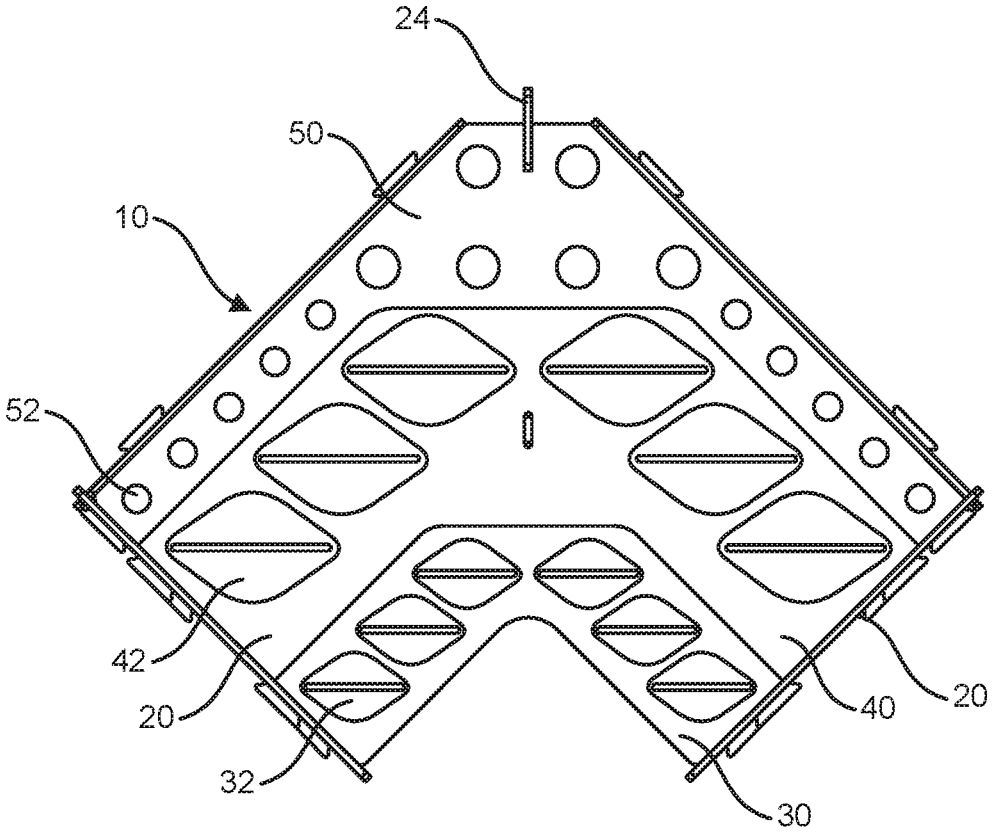
FIG. 2 is a plan view of the first embodiment of the art supply storage rack according to the present invention.
Figure 3:
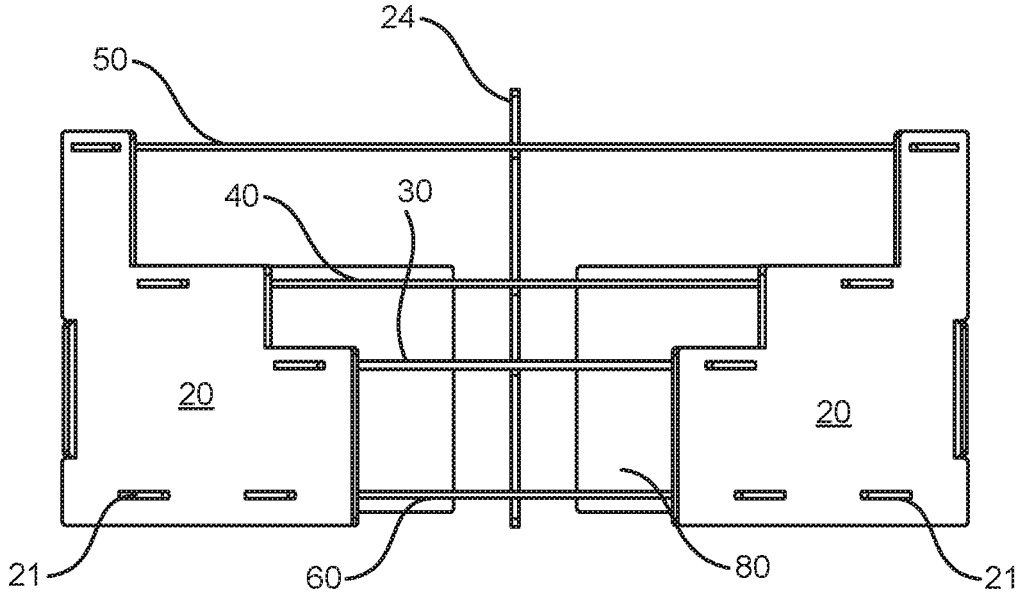
FIG. 3 is a front view of the first embodiment of the art supply storage rack according to the present invention.
Figure 4:
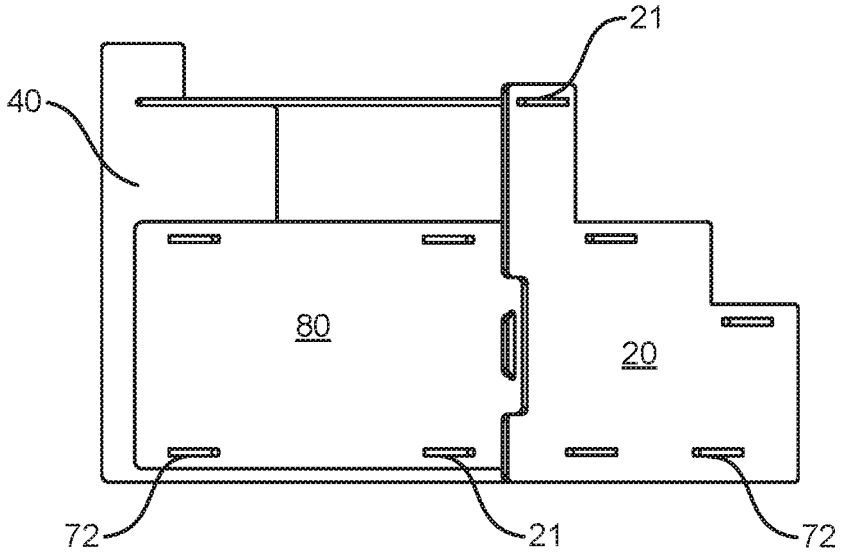
FIG. 4 is a left side view of the first embodiment of the art supply storage rack according to the present invention.
Figure 5:
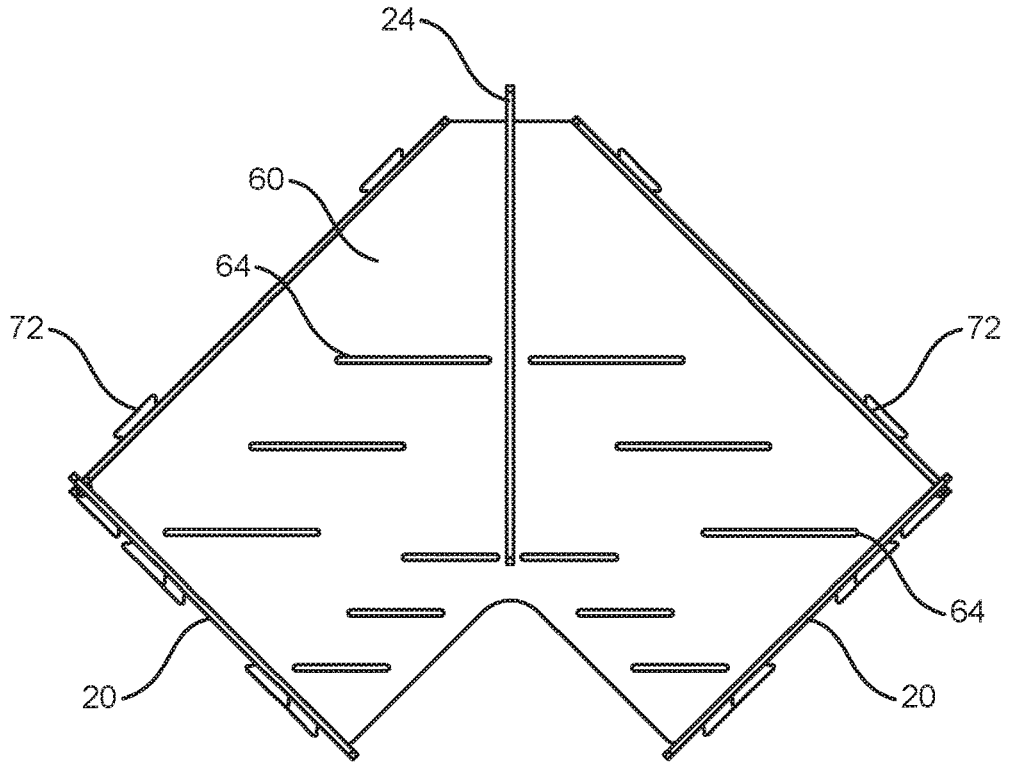
FIG. 5 is a bottom view of the first embodiment of the art supply storage rack according to the present invention.
Figure 6:
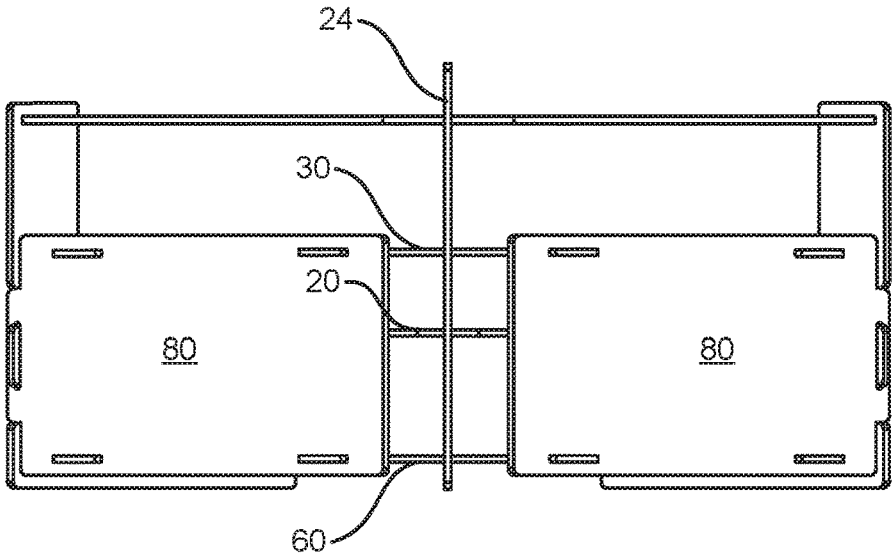
FIG. 6 is a rear view of the first embodiment of the art supply storage rack according to the present invention.
Figure 7:
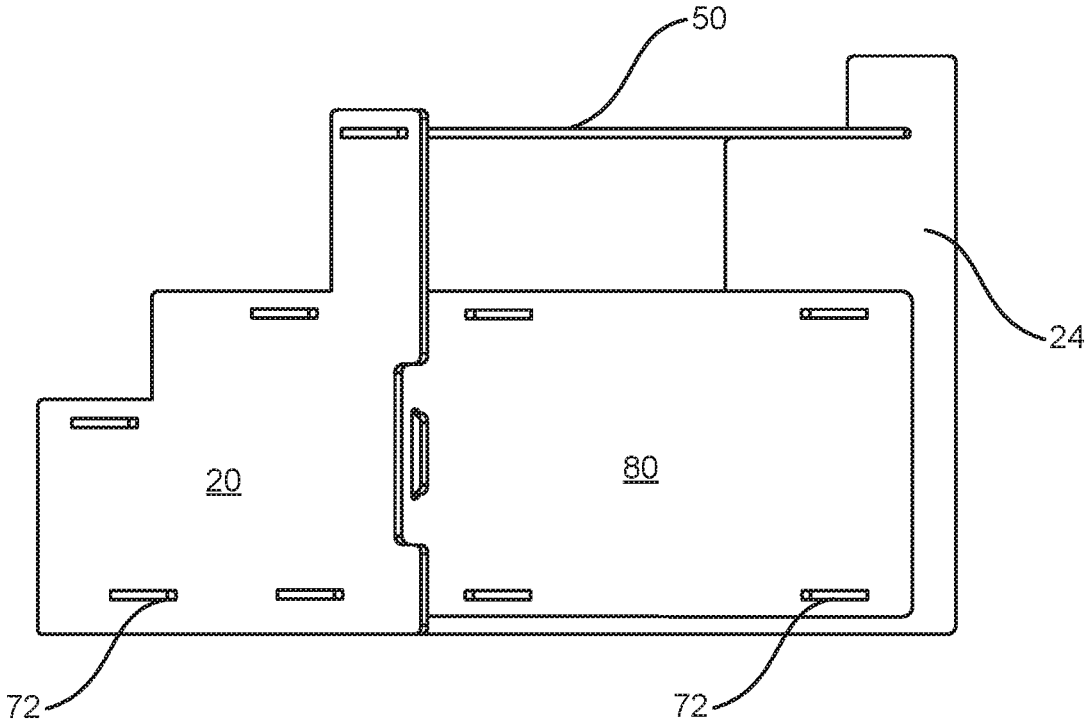
FIG. 7 is a right side view of the first embodiment of the art supply storage rack according to the present invention.
Figure 8:
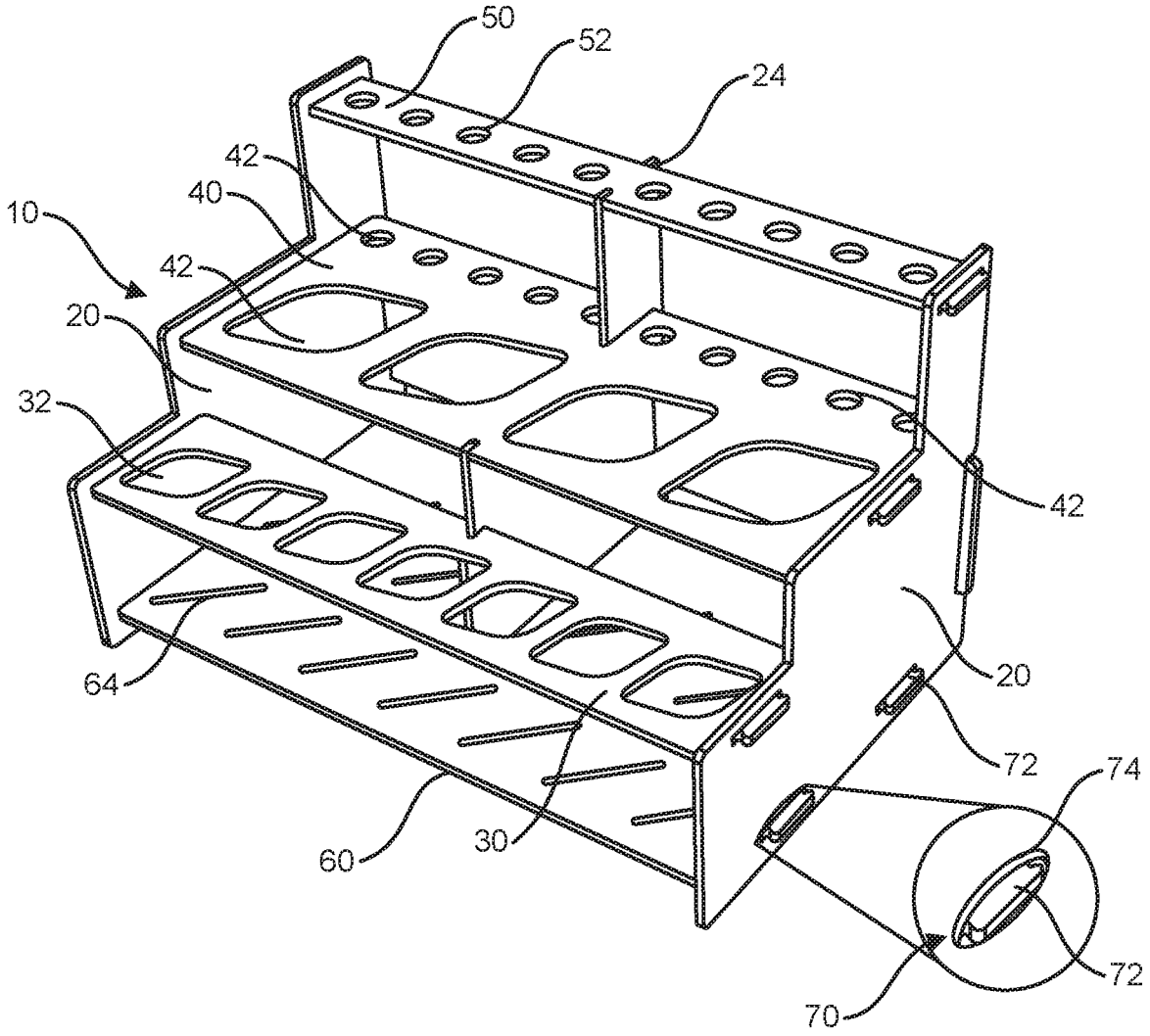
FIG. 8 is a perspective view of a second embodiment of the art supply storage rack according to the present invention.
Figure 9:
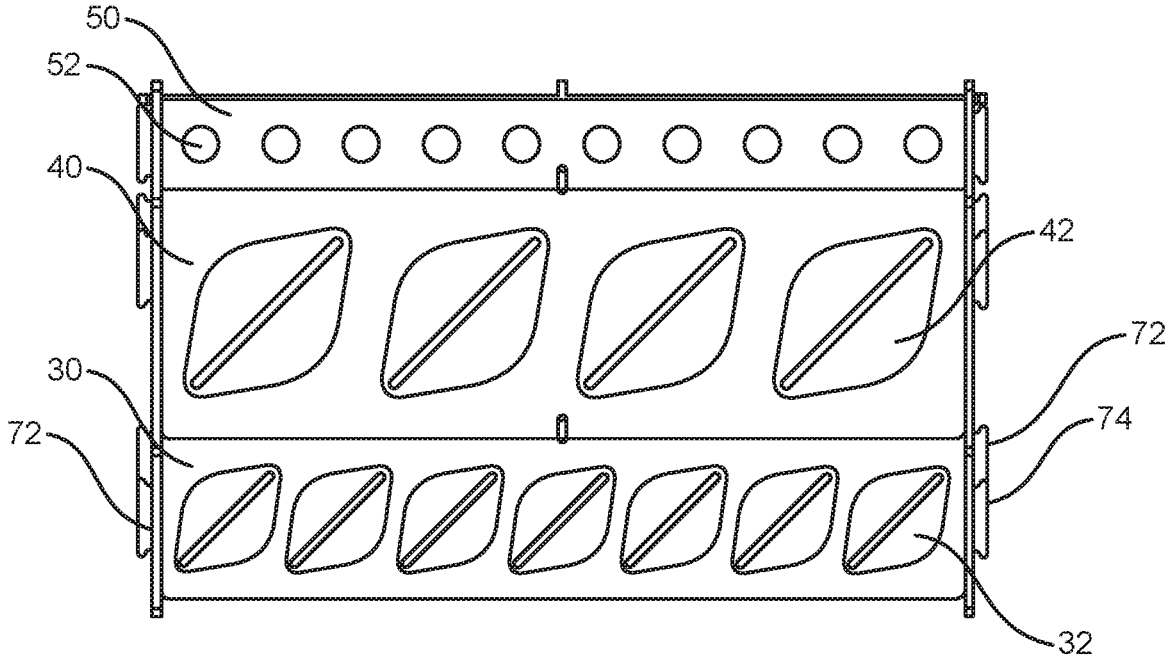
FIG. 9 is a plan view of the second embodiment of the art supply storage rack according to the present invention.
Figure 10:
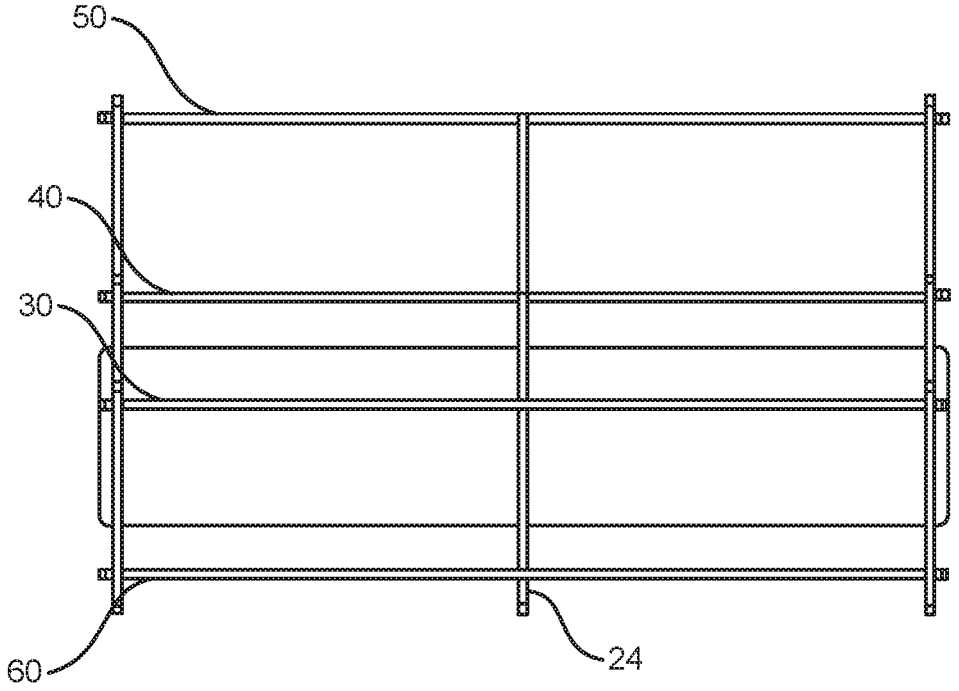
FIG. 10 is front view of the second embodiment of the art supply storage rack according to the present invention.
Figure 11:
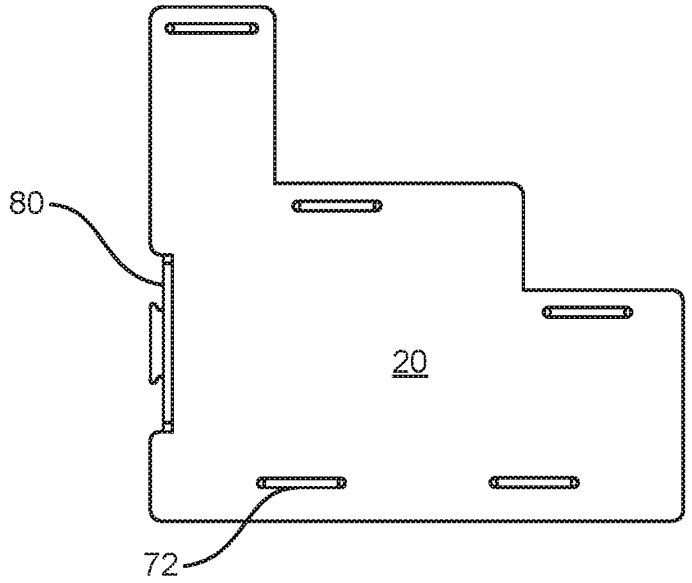
FIG. 11 is a left side view of the second embodiment of the art supply storage rack according to the present invention.
Figure 12:
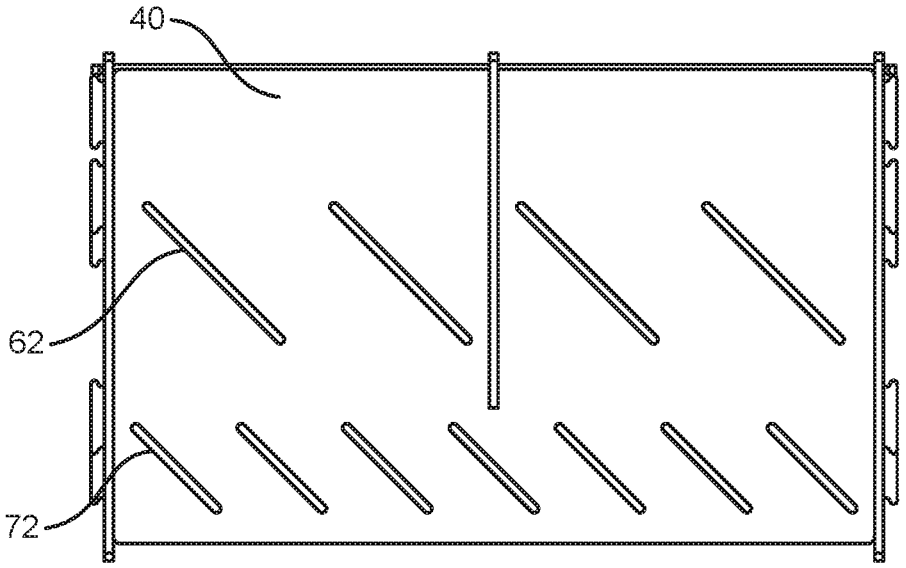
FIG. 12 is a bottom view of the second embodiment of the art supply storage rack according to the present invention.
Figure 13:
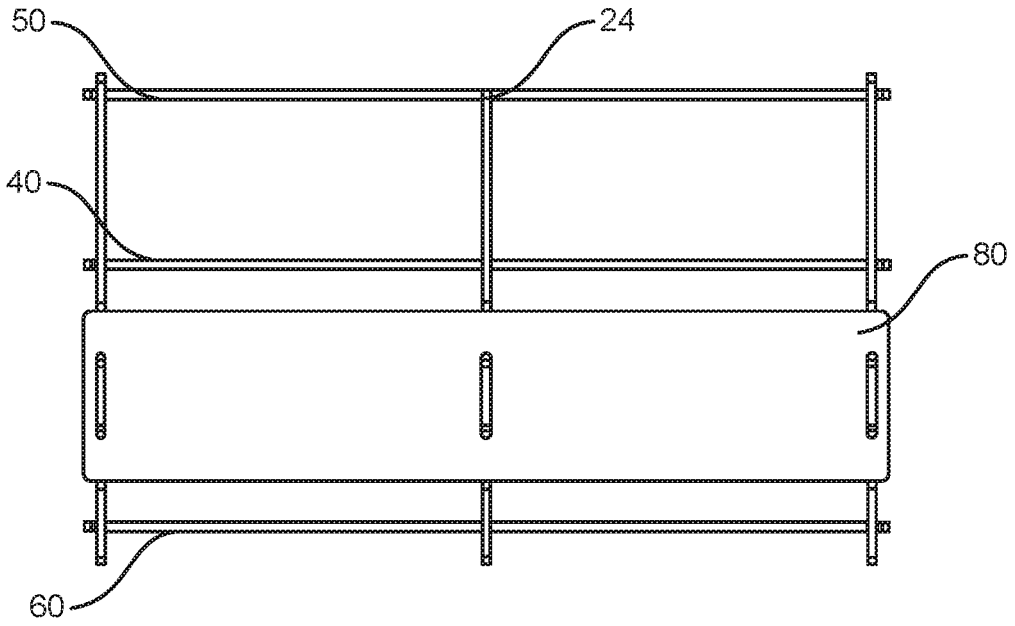
FIG. 13 is a rear view of the second embodiment of the art supply storage rack according to the present invention.
Figure 14:
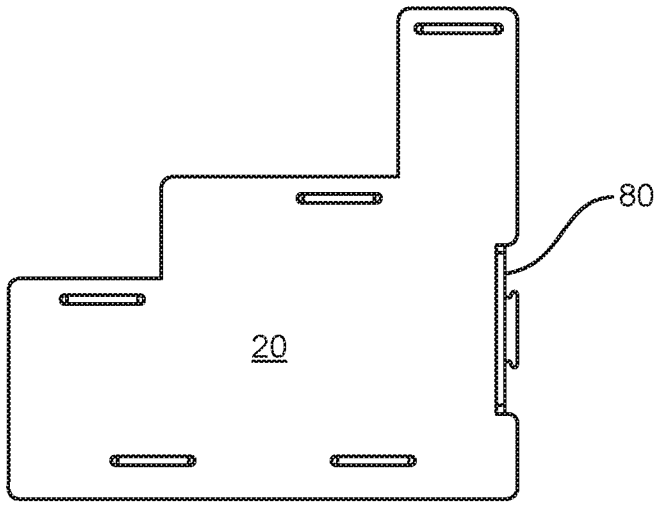
FIG. 14 is a right view of the second embodiment of the art supply storage rack according to the present invention.
Figure 15:
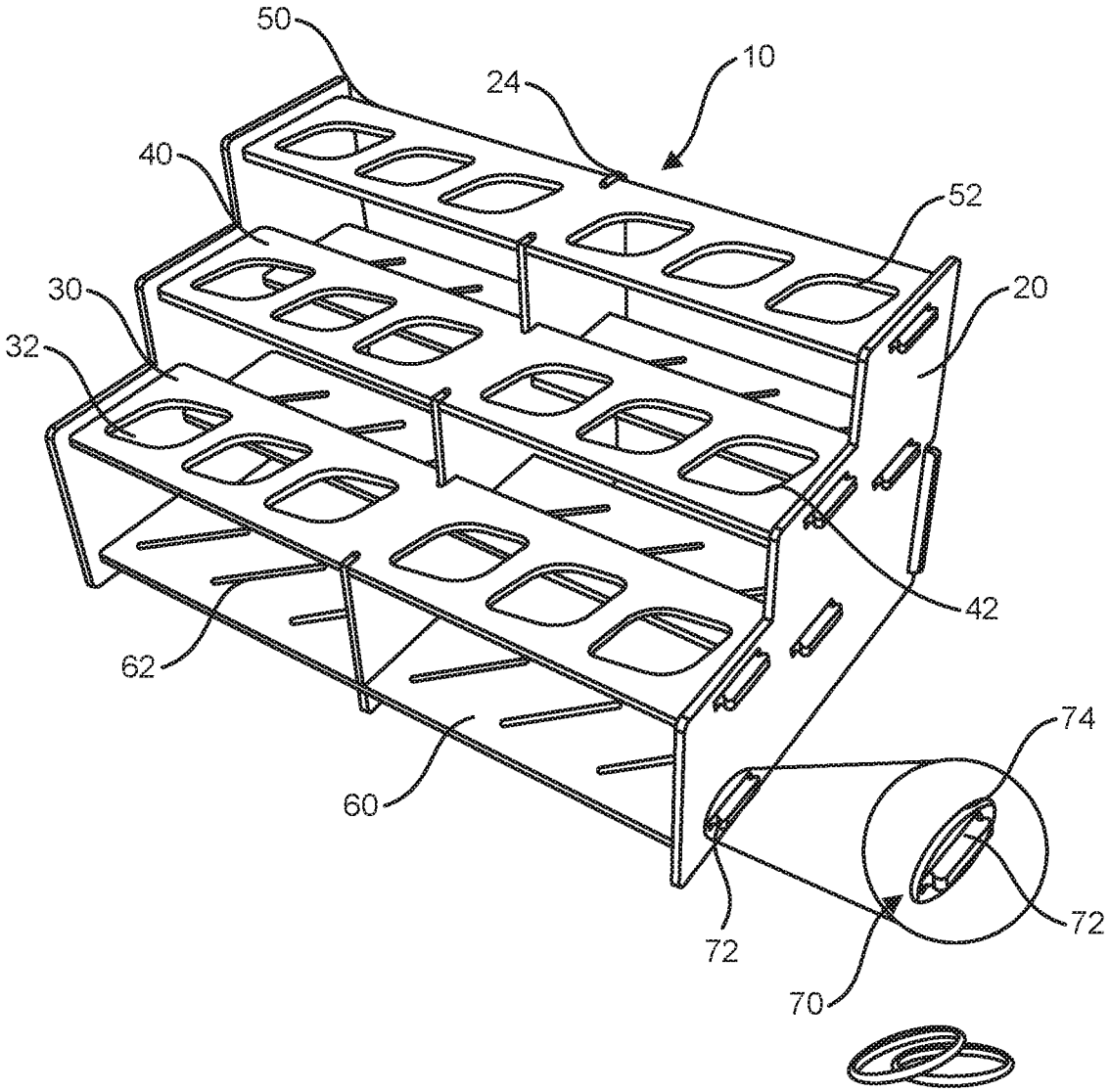
FIG. 15 is a perspective view of a third embodiment of the art supply storage rack showing our new design according to the present invention.
Figure 16:
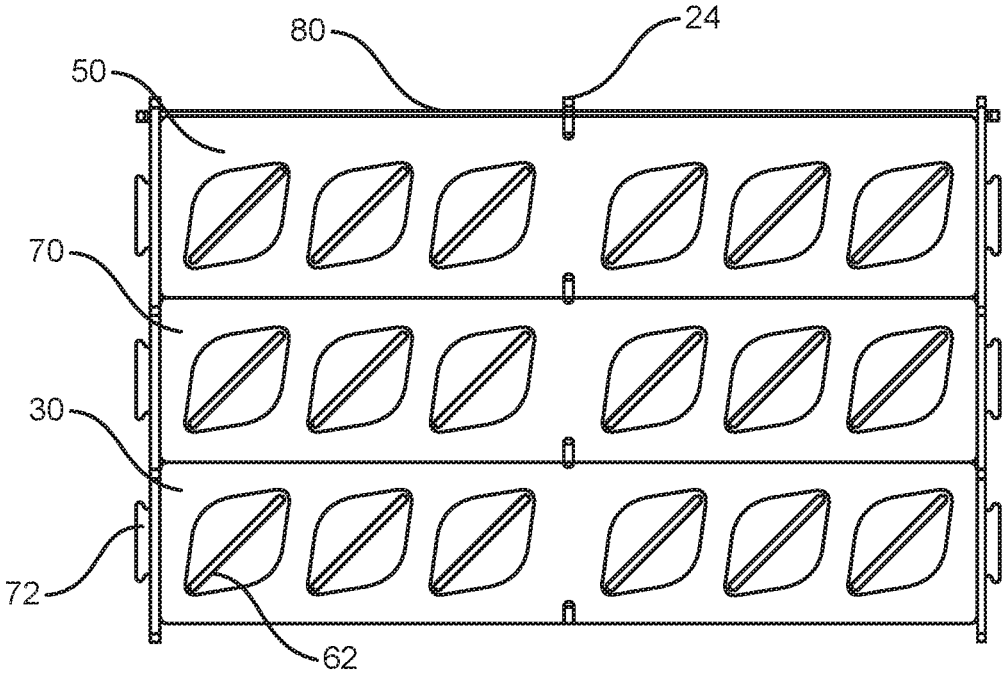
FIG. 16 is a plan view of the third embodiment of the art supply storage rack according to the present invention.
Figure 17:
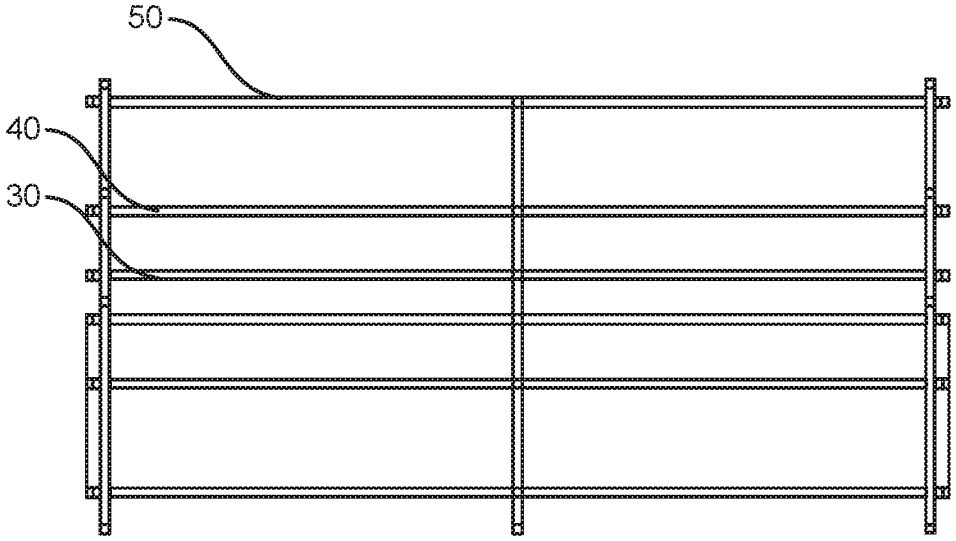
FIG. 17 is a front view of the third embodiment of the art supply storage rack according to the present invention.
Figure 18:
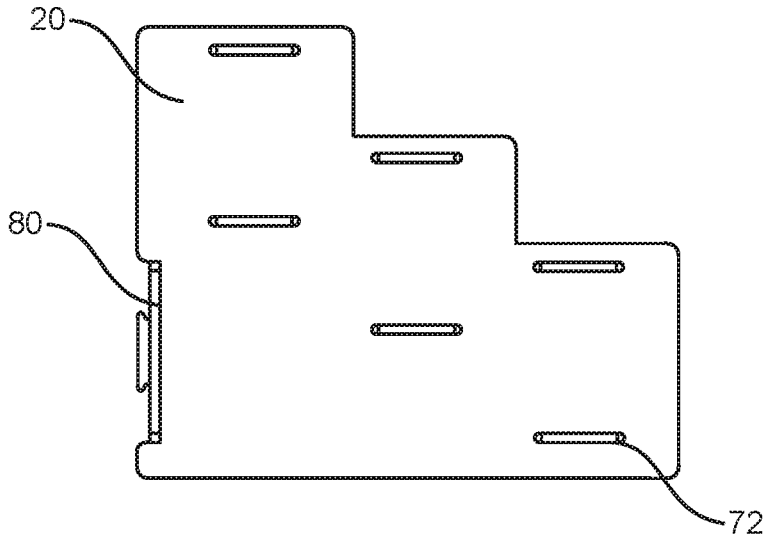
FIG. 18 is a left side view of the third embodiment of the art supply storage rack according to the present invention.
Figure 19:
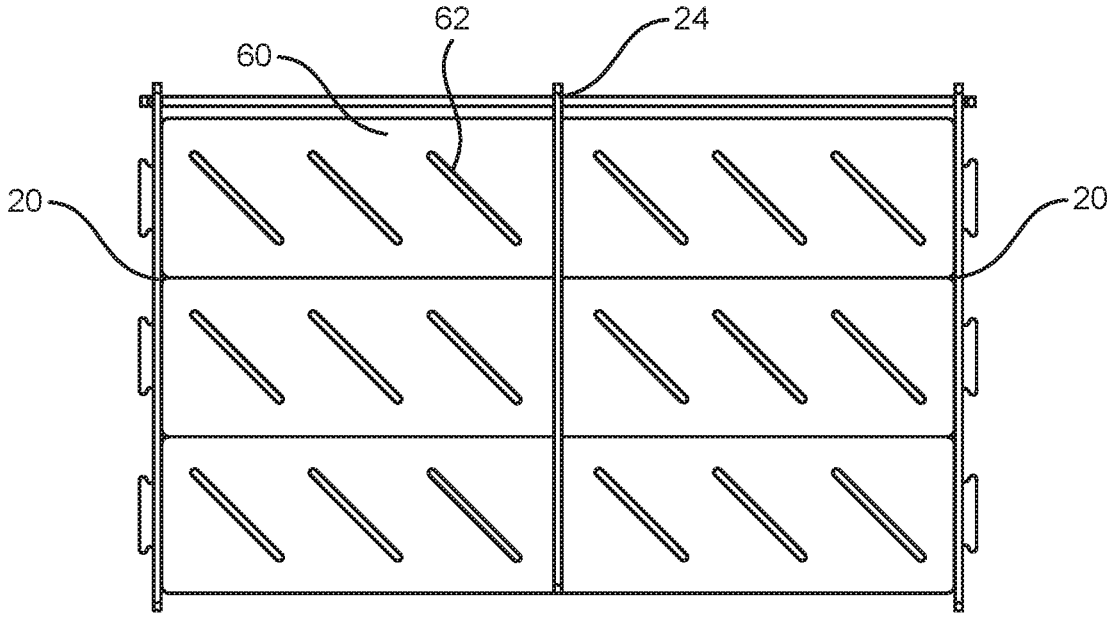
FIG. 19 is a bottom view of the third embodiment of the art supply storage rack according to the present invention.
Figure 20:
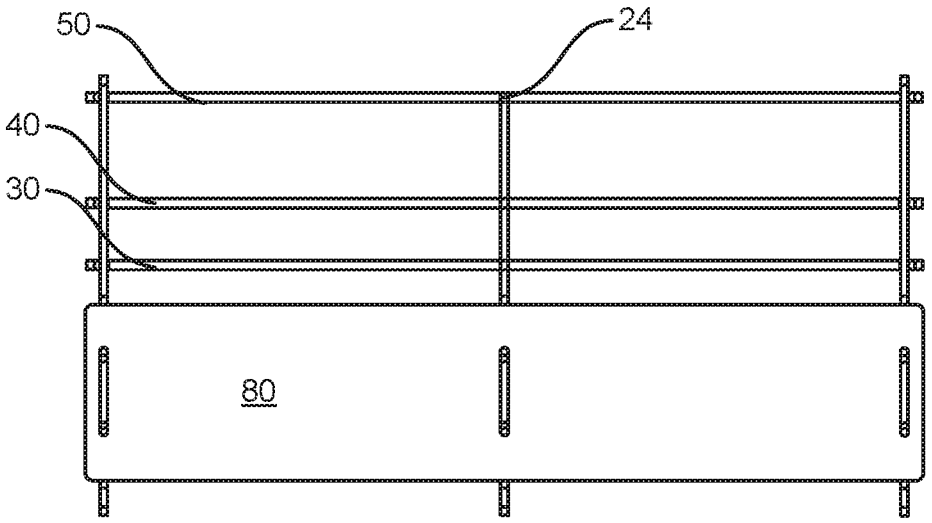
FIG. 20 is a rear view of the third embodiment of the art supply storage rack according to the present invention.
Figure 21:
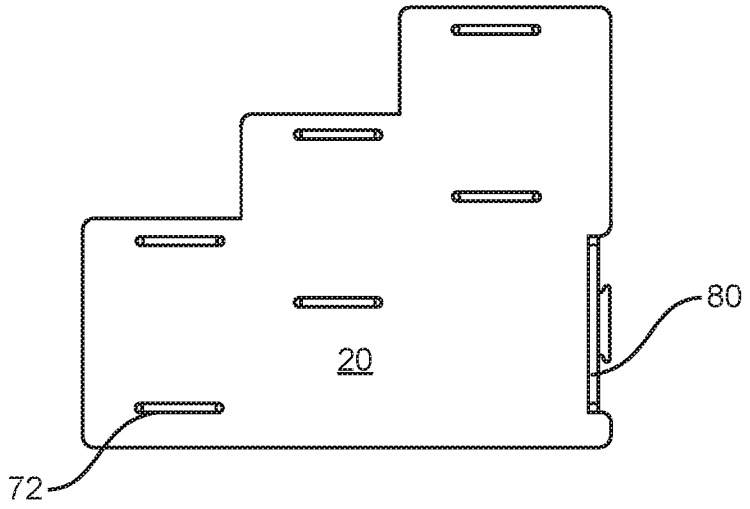
FIG. 21 is a right side view of the third embodiment of the art supply storage rack according to the present invention.
Figure 22:
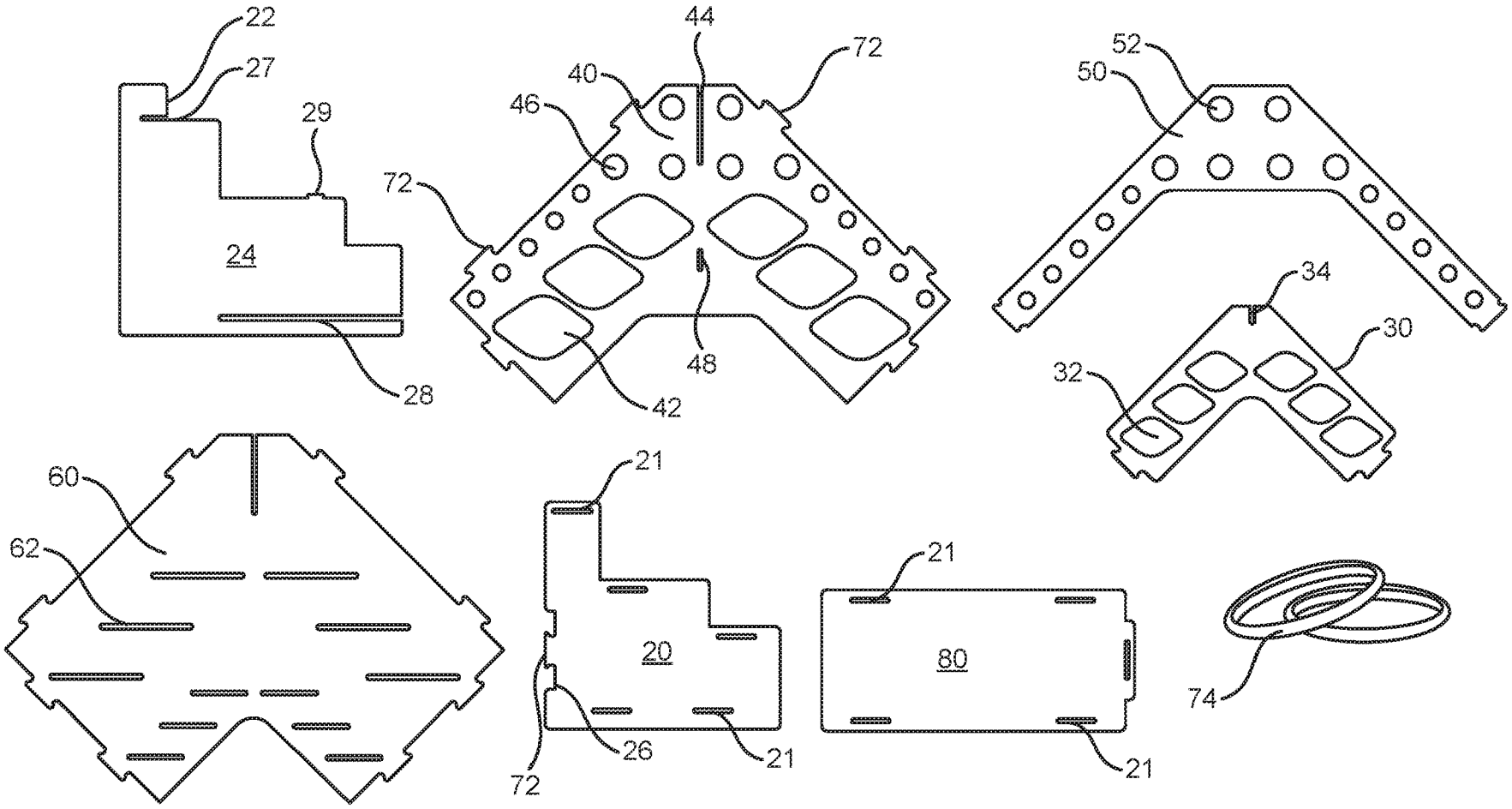
FIG. 22 illustrates the constituent parts of the embodiment of the art supply storage rack shown in FIG. 1.

The embodiments illustrated in FIGS. 1, 8 and 15 are similar and for convenience and to prevent confusion, like elements in each embodiment will bear identical reference numerals. More specifically, the embodiment in FIGS. 1-7 is the most intricate and includes the most features and will therefore be discussed in detail. The reader will note that the other embodiments are similar and a detailed discussion thereof is not deemed necessary.

Referring more specifically to the drawings and particularly to FIGS. 1-7 and FIGS. 22-30 a first embodiment of the art supply storage rack is there illustrated. The rack generally indicated at 10 was developed for storing and organizing paint tubes of the type having a tube body with an orifice at one end through which paint is expressed and a sealed opposite end. The rack 10 can also hold paintbrushes of the type having an elongate handle with a proximal end with bristles and a distal end.

The rack 10 has a plurality of vertical supports in the form of a pair of end caps 20 at each end thereof and a central vertical support member 24. Additionally, the end caps 20 include horizontal slots 22 and a cut-out portion 26 along a portion of the rear edge thereof, the function of which will be more fully explained herein below. A central vertical support member 24 with upper slot 27 and lower slot 28 provides additional structural support to the rack.

The rack has lower horizontal member 30, middle horizontal member 40 and upper horizontal member 50. The lower horizontal member 30 has a plurality of spaced holes defining openings 32 and outwardly projecting tabs 72 which form part of the connector means 70 that act to hold the rack together. The middle horizontal member 40 has a plurality of spaced holes defining openings 42, a slot 44 and outwardly projecting tabs 72 which also form part of the connector means 70 and the upper horizontal member 50 also has a plurality of holes defining openings 52 and outwardly projecting tabs 72 which also form part of the connector means 70.

A base member 60 has a plurality of spaced retaining means 62 in the form of elongated slots cut therein. It will be noted that the retaining means 62 could take alternative forms such as a pair of parallel ridges or opposing raised areas that act to secure that sealed end of a paint tube.

As shown in the figures the respective base, lower, middle and upper horizontal members 30, 40, 50 are vertically spaced apart from each other and are connected to end caps or vertical supports 20 at their respective ends collectively forming a frame. The tabs 72 extend through the slots 22 in the vertical supports 20 and elastic bands or elastics 74 are placed thereon to secure the support. In addition, the horizontal members 30, 40, 50 are offset from each other in stepped fashion such that the respective openings 32, 42 overlie a corresponding underlying one of the slots 62 in the base member 60 that together define a paint tube holding shaft. When a paint tube is inserted from above, the sealed end is restingly received in the slot and the orifice end protrudes above the respective opening in the horizontal member. It will be noted that the shape of openings 32, 42 substantially mirrors the shape of a paint tube body so that the sealed end of the paint tube is guided toward the slot 62 when the paint tube is inserted therein and the paint tube body is positioned so that labeling on the paint tube body is visible to the user. Further, openings 32, 42 may be of different sizes to accommodate differently sized paint tubes.

As mentioned above, rack 10 is also designed to vertically hold paintbrushes in addition to paint tubes. To accomplish holing paintbrushes, a section of the middle horizontal member extends beneath the upper horizontal member and includes a second set of holes defining openings 46 that underlie the openings 52 in the upper horizontal member 50. As openings 46, 52 are in linear alignment, they define a paintbrush holding shaft that is adapted to hold the shaft of a paintbrush. As there are a multitude of paint bushes for various purposes, they are of differing sizes and have handles of varying lengths and diameters. The rack may include openings 46, 52 of varying diameters to accommodate differently sized paintbrushes.

A vertical rear stabilization member 80 is connected to the base member 60 and at least one of horizontal members 40, 40, 50, and each of the vertical supports 20 in a manner similar to the connection of the horizontal members are connected to the vertical supports using tabs and elastics.

The rack 10 may be fabricated from any material that is structurally able to support the paint tubes and paint brushes contemplated herein. A laminate wood product of ⅛ (one eighth) inch to ¼ (one forth) inch thickness or plastics such as Nylon® or Polyester® may also be employed. The thickness of the rack components may easily be adjusted in proportion to the size of the paint tubes and brushes to be supported by the rack. It is contemplated that the parts of the rack will be produced by die stamping. Alternatively, the parts could be produced by a molding process.

The embodiments illustrated in FIGS. 1, 8 and 15 are very similar and in view thereof, assembly of the embodiment in FIGS. 1-7 and 22-30 is explained herein below in detail.

Figure 23:
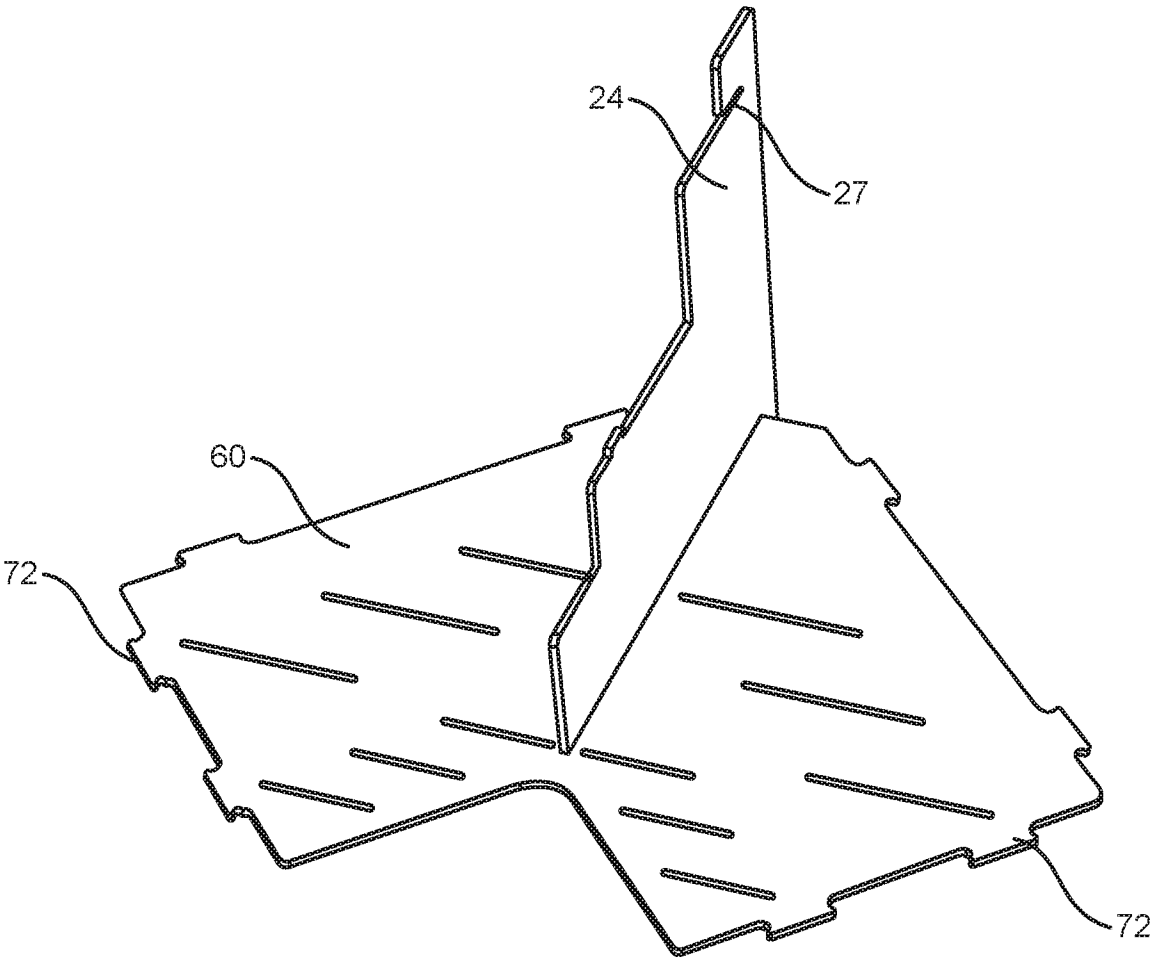
FIG. 23 illustrates the first step of the assembly of the art supply storage rack shown in FIG. 1.

Referring now to the figures:

1. Central support member 20 and based member 60 are connected by inserting base member 60 into slot 28 as shown in FIG. 23.

Figure 24:
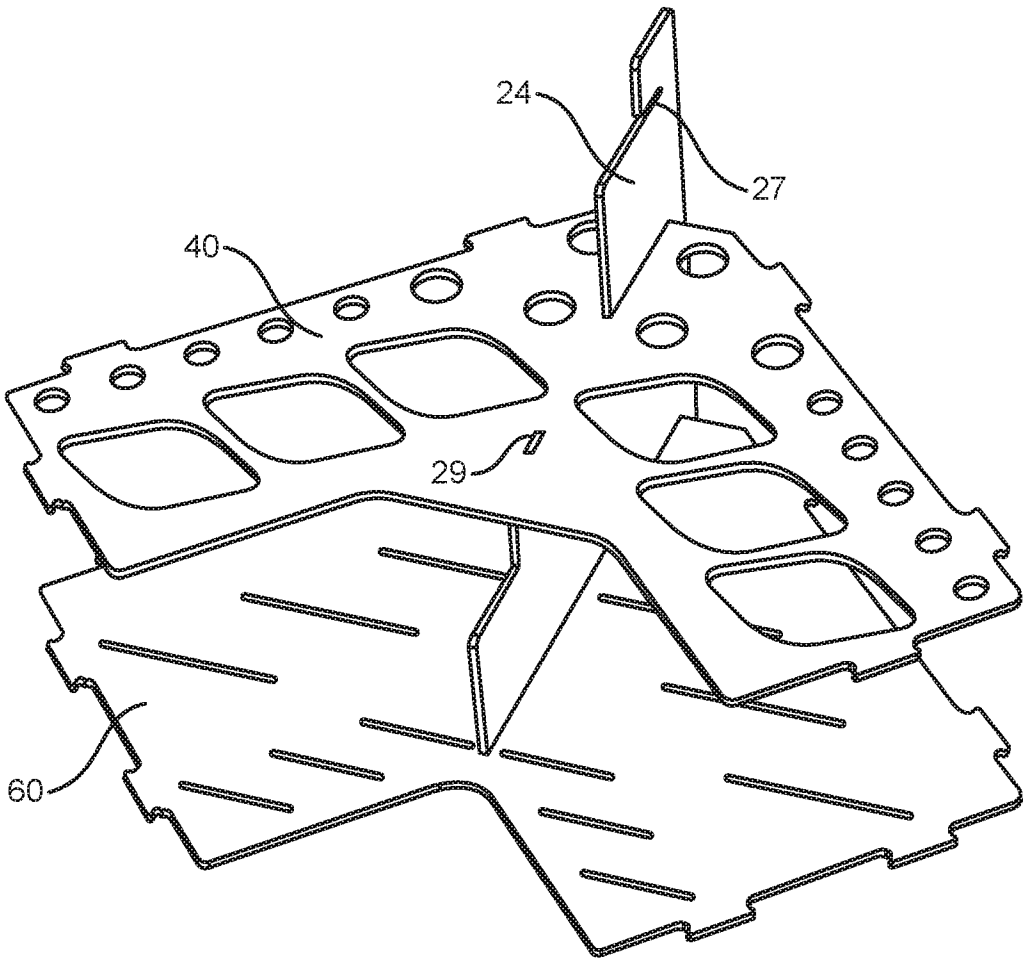
FIG. 24 illustrates the second step of the assembly of the art storage rack shown in FIG. 1.

2. Middle horizontal member 40 is connected to central support member 24 by inserting slot 44 into the second step of middle horizontal member 40 so that tab 29 mates with opening 48 as shown in FIG. 24.

Figure 25:
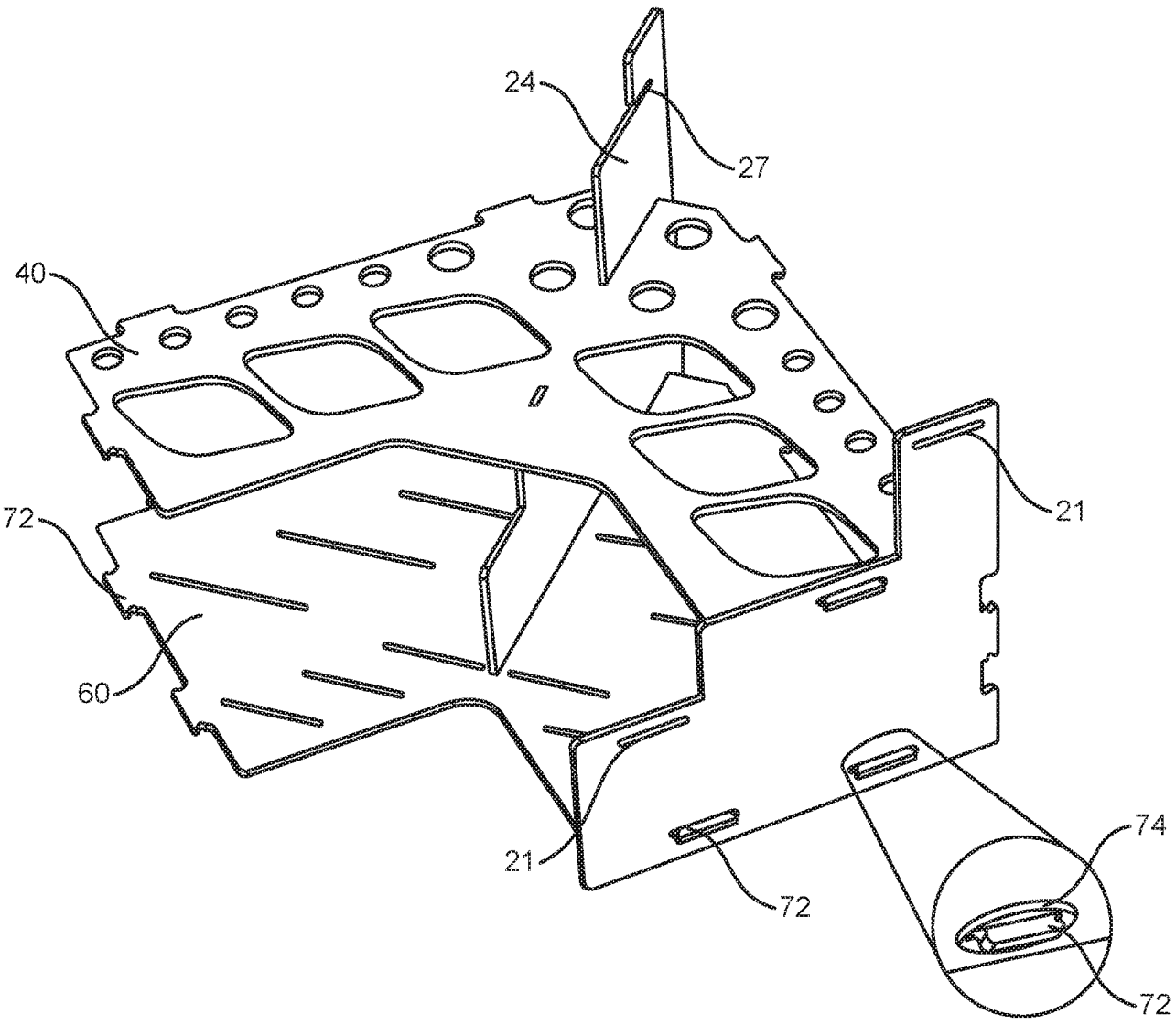
FIG. 25 illustrates the third step of the assembly of the art storage rack shown in FIG. 1.

3. The slot 21*s* of right side vertical support 20 are inserted into the tabs 72 of base member 60 and middle horizontal member 40 and elastics 74 are attached to each tab as shown in FIG. 25.

Figure 26:
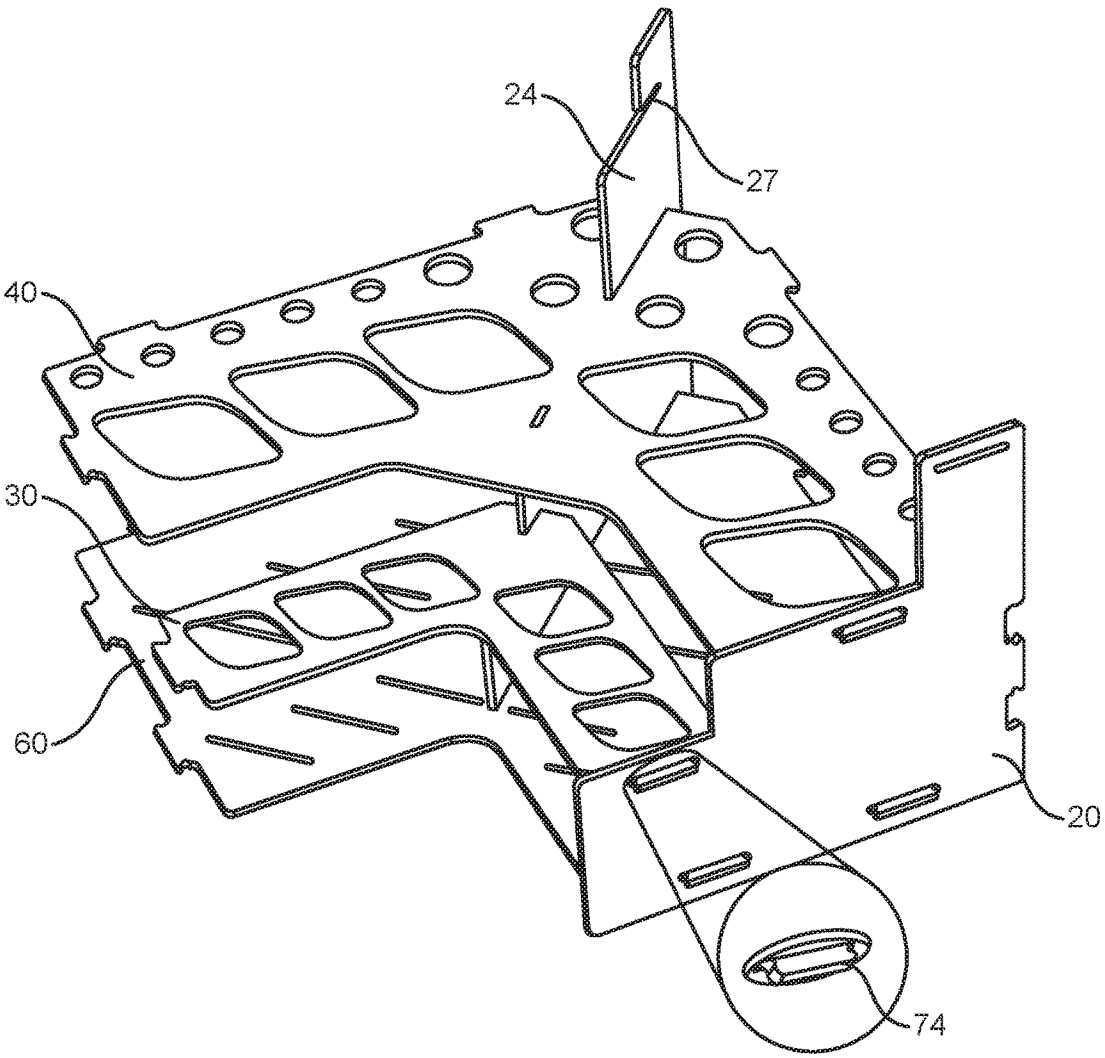
FIG. 26 illustrates the forth step of the assembly of the art storage rack shown in FIG. 1.

4. Lower horizontal member 30 is placed upon the lower step of central vertical support 24 with slot 34 inserted therein. Tabs 72 are inserted into the slots 62 of vertical support 24 as shown in FIG. 26.

Figure 27:
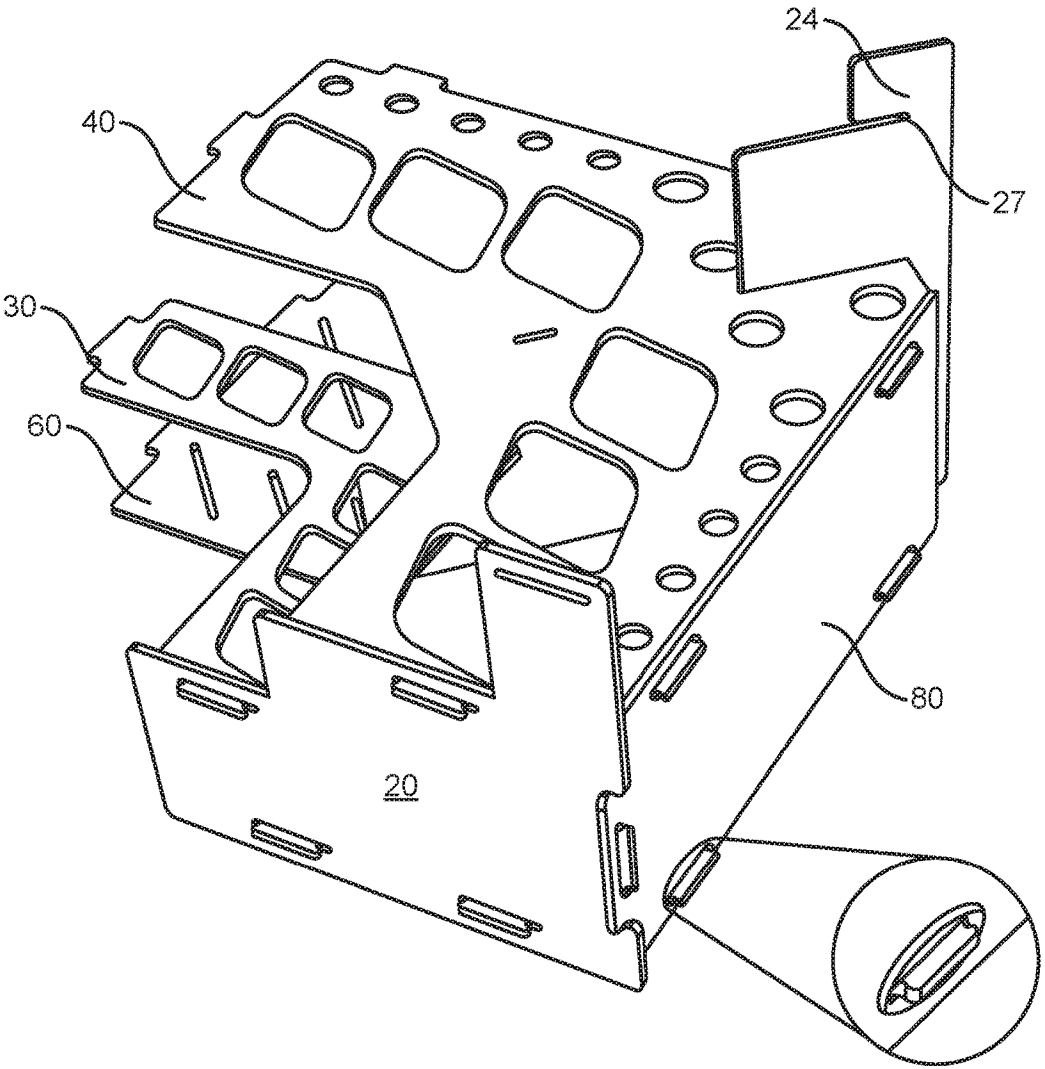
FIG. 27 illustrates the fifth step of the assembly of the art storage rack shown in FIG. 1.

5. The slots 21 of right rear stabilizing member 80 are inserted into the rear tabs on base member 60 and middle member 40 and elastics 74 are attached to each tab as shown in FIG. 27.

Figure 28:
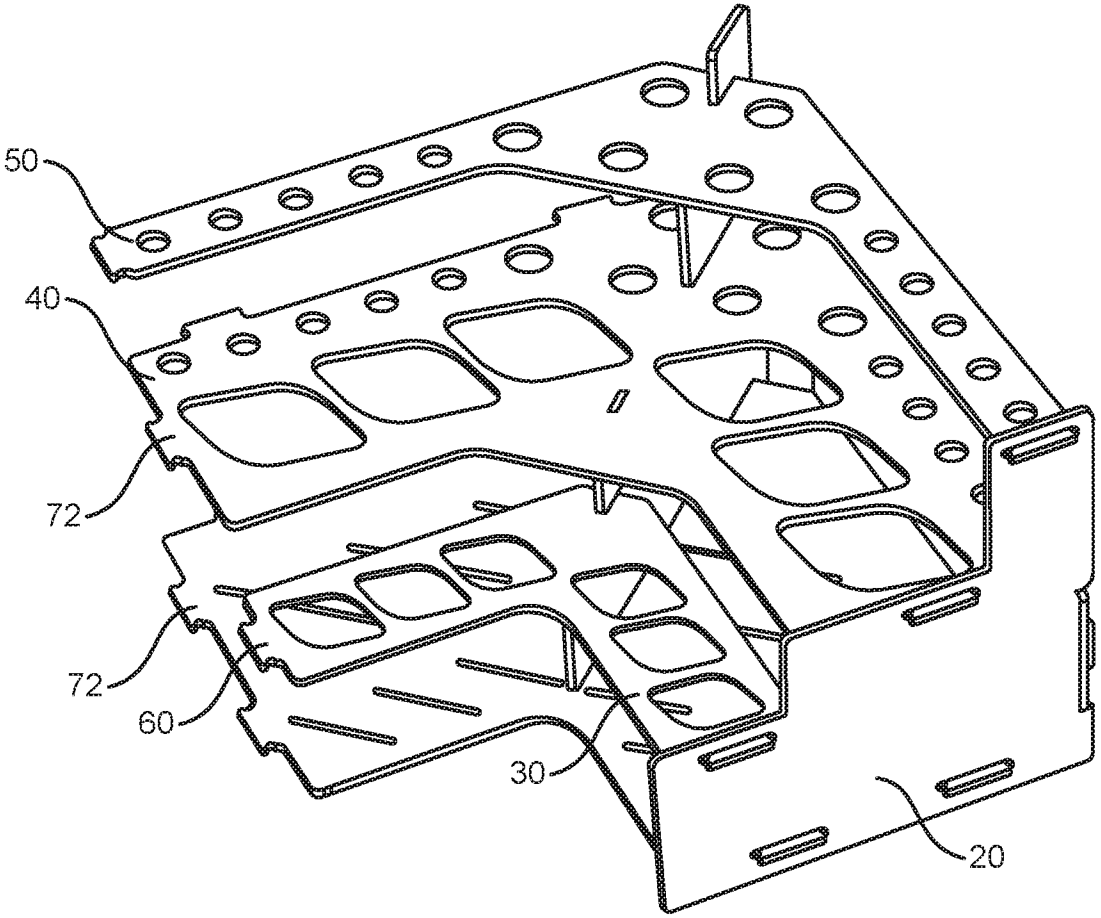
FIG. 28 illustrates the sixth step of the assembly of the art storage rack shown in FIG. 1.

6. Upper horizontal member 50 is inserted into the upper slot on middle horizontal member 40 and tab 72 is inserted into slot 62 and elastics 74 are attached to the tab as shown in FIG. 28.

Figure 29:
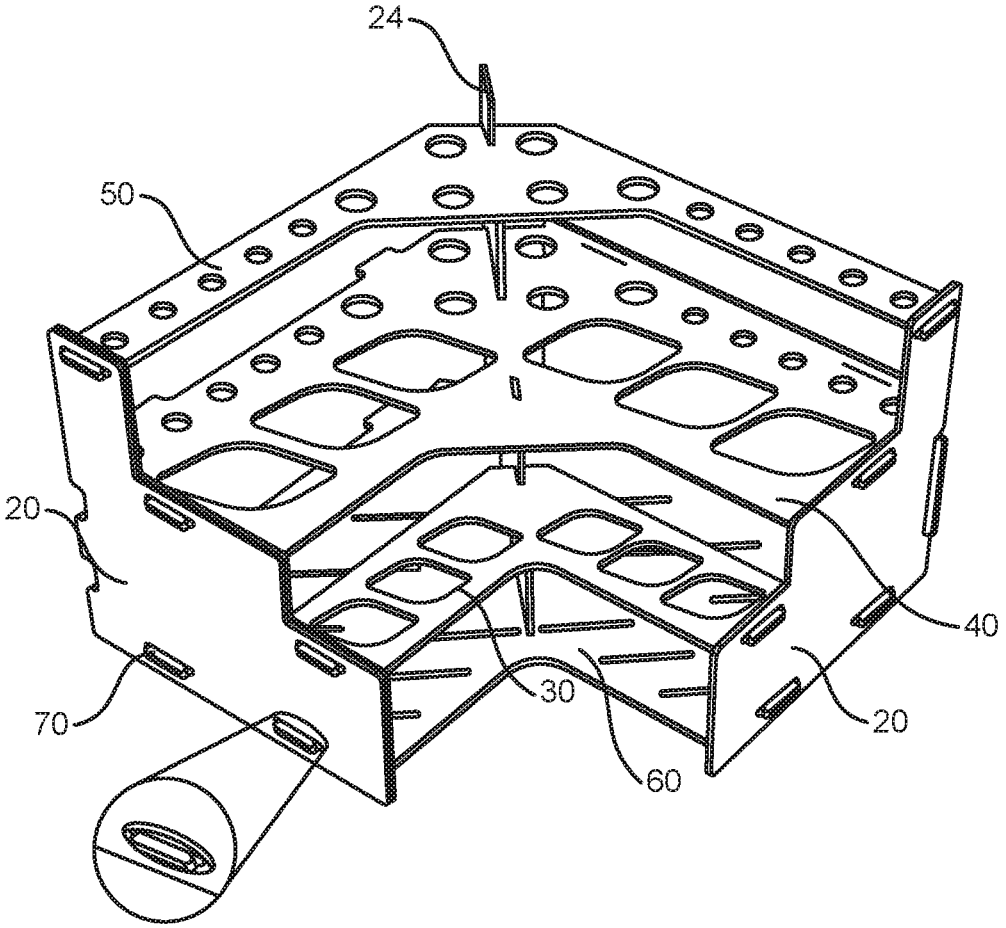
FIG. 29 illustrates the seventh step of the assembly of the art storage rack shown in FIG. 1.

7. The slots 21 of right side vertical support 30 are inserted into the tabs of base member 60, and lower, middle and upper horizontal members, 30,40,50 and elastics added as above as shown in FIG. 29.

Figure 30:
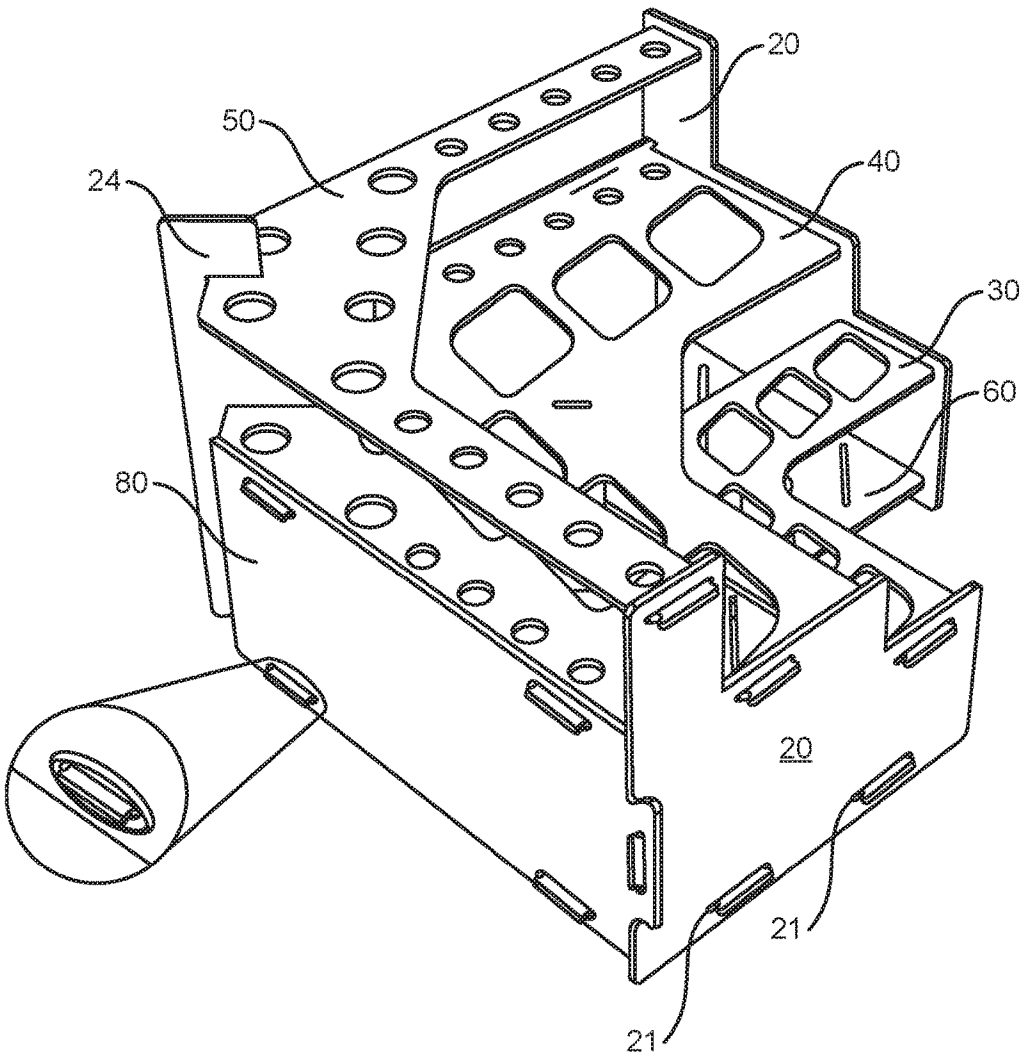
FIG. 30 illustrates the eighth step of the assembly of the art storage rack shown in FIG. 1.

8. The slots of left rear stabilizing member 80 are inserted into the rear tabs of base member 60 and middle member 40 and elastics 74 attached to each tab to complete the rack as shown in FIG. 30.

The present invention, of course may be carried out in other specific ways than those herein set forth without departing from the spirit and essential characteristics of the invention. The present embodiments are therefore, to be considered in all respects as illustrative and not restrictive, and all changes coming within the meaning and equivalency range of the appended claims are intended to be embraced therein.

That which is claimed is:

1. An art supply storage rack for storing and organizing paint tubes each having a tube body with an orifice at one end through which paint can be received and a sealed opposite end, the art supply storage rack comprising:

a plurality of vertical support panels each having a plurality of slots therein;

a lower horizontal panel having a plurality of first spaced openings therethrough and outwardly extending tabs at ends thereof;

a middle horizontal panel having a plurality of second spaced openings therethrough and outwardly extending tabs at ends thereof;

an upper horizontal panel having a plurality of third spaced openings therethrough and outwardly extending tabs at ends thereof;

wherein a portion of the middle horizontal panel extends underneath the upper horizontal panel;

a base panel having outwardly extending tabs at ends thereof and a retaining means comprising at least one of a plurality of spaced retaining slots and a plurality of spaced elevated ridges, said base panel being positioned vertically spaced apart from and beneath said lower horizontal panel, said middle horizontal panel, and said upper horizontal panel;

said outwardly extending tabs of each of the lower, middle, and upper horizontal panels and the outwardly extending tabs of the base panel are inserted within the slots of said vertical support panels to define a frame, wherein at least one generally ring shaped elastic band surrounds at least one respective outwardly extending tab to secure the frame in place; said lower, middle, and upper horizontal panels are vertically spaced apart and offset from each other in a stepped fashion and wherein said first spaced openings and said second spaced openings overlie the retaining means of the base panel, wherein upper portions of the paint tubes are configured to be held within at least one of the first spaced openings and the second spaced openings with the sealed ends of the paint tubes being received by the retaining means and the orifice ends of the paint tubes protruding above the at least one of the first spaced openings and the second spaced openings.

2. The art supply storage rack according to claim 1 wherein said first and second spaced openings substantially mirror the shape of respective paint tube bodies so that the sealed ends of the paint tubes are guided toward the retaining means when the paint tubes are inserted therein and the paint tube bodies are positioned so that labels on the paint tube bodies are visible.

3. The art supply storage rack according to claim 2 wherein the first openings and the second openings are different sizes to accommodate variously sized paint tubes.

4. The art supply storage rack according to claim 1 wherein the third spaced openings are configured to receive paintbrushes each having an elongate handle at a proximal end and bristles at a distal end respectively; and wherein the middle horizontal panel further includes a plurality of fourth spaced openings that are configured to receive the paintbrushes, the respective third spaced openings overly the fourth openings to retain the paintbrushes in an upright position.

5. The art supply storage rack according to claim 1 wherein said vertical support panels define a pair of end caps, wherein the art supply storage rack further comprises a central support having slots therein, and wherein said slots of the central support are constructed and arranged to slidingly receive the respective lower, middle, and upper horizontal panels.

6. The art supply storage rack according to claim 1 further including a vertical rear stabilization member adapted to be connected to the base panel, at least one of the lower, middle, and upper horizontal panels, and each of the vertical support panels.

7. An art supply storage rack for storing and organizing paint tubes each having a tube body with an orifice at one end through which paint can be received and a sealed opposite end, the art supply storage rack comprising:

a plurality of vertical support panels each having a plurality of slots therein and a plurality of top surfaces, wherein the top surfaces of each vertical support panel are vertically spaced and offset from each other in a stepped fashion;

a lower horizontal panel having a plurality of first spaced openings therethrough and outwardly extending tabs at ends thereof;

a middle horizontal panel having a plurality of second spaced openings therethrough and outwardly extending tabs at ends thereof;

an upper horizontal panel having a plurality of third spaced openings therethrough and outwardly extending tabs at ends thereof;

wherein each spaced opening in the upper, lower and middle panels substantially mirror a shape of a respective paint tube body;

a plurality of base panels each having outwardly extending tabs at ends thereof and a plurality of spaced apart retaining slots, wherein a respective base panel is positioned vertically spaced apart from and beneath each of said lower horizontal panel, said middle horizontal panel, and said upper horizontal panel respectively;

said outwardly extending tabs of each of the lower, middle, and upper horizontal panels and the outwardly extending tabs of the base panels are inserted within the slots of said vertical support panels to define a frame, wherein at least one generally ring shaped elastic band surrounds at least one respective outwardly extending tab to secure the frame in place; said lower, middle, and upper horizontal panels are vertically spaced apart and offset from each other in a stepped fashion and wherein said first spaced openings, said second spaced openings, and said third spaced openings overlie the corresponding retaining slots of the base panels, wherein upper portions of the paint tubes are configured to be held within at least one of the first, second, and third spaced openings with the sealed ends of the paint tubes being received by the respective retaining slots of a respective base panel and the orifice ends of the paint tubes protruding above the at least one of the first, second, and third spaced openings so that labels on the paint tubes are visible.

8. The art supply storage rack according to claim 7 wherein said vertical support panels define a pair of end caps, wherein the art supply storage rack further comprises a central support having slots therein, and wherein said slots of the central support are constructed and arranged to slidingly receive the respective lower, middle, and upper horizontal panels.

9. The art supply storage rack according to claim 7 wherein the first spaced openings in the lower horizontal panel are smaller than the second spaced openings in the middle horizontal panel.

10. The art supply storage rack according to claim 7 further including a vertical rear stabilization member adapted to be connected to the base panels, at least one of the lower, middle, and upper horizontal panels, and each of the vertical support panels.

* * * * *